United States Patent [19]

Smith

[11] 4,141,262

[45] Feb. 27, 1979

[54] REMOTE OPERATED WRENCH

[76] Inventor: Clyde D. Smith, 609 Rorary, Richardson, Tex. 75081

[21] Appl. No.: 794,453

[22] Filed: May 6, 1977

[51] Int. Cl.[2] ..... B25B 13/46

[52] U.S. Cl. ..... 81/57.39

[58] Field of Search ..... 81/57.39, 57.42, 57.43, 81/177 F

[56] References Cited

U.S. PATENT DOCUMENTS

| | | | |
|---|---|---|---|
| 2,637,233 | 5/1953 | Hoffman | 81/57.43 |
| 2,726,563 | 12/1955 | Blackburn | 81/57.39 |

*Primary Examiner*—James L. Jones, Jr.

*Attorney, Agent, or Firm*—Richards, Harris & Medlock

[57] ABSTRACT

The specification discloses a remote operated wrench whereby a squeezable handle connected to a ratchet via a flexible cable imparts a torque to a drive. The ratchet and drive are carried by a housing. A guide extending from the housing receives a flexible cable which imparts a torque to a movable arm pivotally mounted on the housing and extending therefrom. A pawl is pivotally mounted on the arm and extends therefrom so that it engages and turns the ratchet wheel when the arm is rotated in one direction, but slips freely over the wheel when the arm is rotated in the opposite direction. A drive is provided on both sides of the ratchet wheel for a gripping means such as a socket or stud to grip a workpiece. A strut also extending from the housing restrains movement of the housing when the arm engages the ratchet wheel. The flexible cable engages the arm and pivots it toward the guide when the squeezable handle is compressed. A spring acting between the guide and arm returns the movable arm to its rest position after the tension in the cable is relaxed. The cable is carried in a flexible housing having one end anchored in the guide, the other in the squeezable handle. When compressed, the squeezable handle strains the cable thereby imparting a torque to the arm which engages the ratchet wheel and drive.

9 Claims, 3 Drawing Figures

REMOTE OPERATED WRENCH

BACKGROUND OF THE INVENTION

1. Field of the Invention

The present invention relates to wrenches and more particularly to remotely operated ratchet wrenches.

2. Description of the Prior Art

In the application of wrenches to machinery, the mechanic sometimes encounters difficulty in removing or tightening nuts or bolts in a confined area which does not provide sufficient space to maneuver an ordinary wrench handle. In instances in which nuts or bolts are so placed that a wrench handle has room to swing through a small angle, the ordinary ratchet wrench may be effective. Although ratchet wrenches are therefore sometimes practical even in confined areas, there are still many applications where a mechanic cannot effectively swing a wrench handle through the required angle even with such wrenches. Various attempts have been made to cope with this problem including design of squeeze action wrenches such as those disclosed in U.S. Pat. Nos. 2,726,563, 3,616,714 and 3,557,644. These employ a squeezable handle to drive a ratchet, permitting the mechanic to turn a bolt or nut without rotating the handle. In the wrench disclosed in U.S. Pat. No. 2,726,563, a long rigid handle is connected one end to a ratchet head, the other end to a squeezable trigger some distance from a nut or bolt. The operator thus has somewhat greater versatility in driving a ratchet in different environments. Such devices are limited by the rigid connection in the same plane as the ratchet. While in some instances screwdriver or lug wrenches applied perpendicularly to a nut or bolt may be operable where the above discussed wrenches are not, often no prior art wrenches can work in confined areas efficiently.

SUMMARY OF THE INVENTION

The present invention contemplates a wrench which can be actuated at a distance by a flexible cable.

In accordance with one aspect of the present invention, a gripping means for gripping a threaded workpiece is rigidly connected to a pawl and ratchet wheel means for rotating the gripping means in one direction only. A flexible cable housing connects the wrench to a control means. A flexible actuator cable extends through the cable housing and is secured at one end to the pawl and ratchet wheel means, at the other end to the control means which reciprocates the cable in the housing to activate the ratchet and pawl wheel means.

In one particular embodiment of the invention, a housing encloses a ratchet wheel, a drive integral therewith and a movable arm. The housing has a guide and strut extending therefrom. The strut engages some immovable object to prevent movement of the housing when the movable arm actuates the gripping means; the guide receives the cable and provides support enabling a torque to be applied to the arm. A movable arm is pivotably mounted in the housing and extends therefrom. A pawl, pivotally mounted on the arm and biased toward the ratchet wheel, engages a ratchet wheel, which is rotatably mounted in the housing, when the arm is rotated in one direction, but permits the arm to slip freely over the ratchet wheel when the arm is rotated in the opposite direction. On both sides of the ratchet wheel is a drive adapted to receive a gripping element such as a socket or stud. A spring causes the arm to return to its rest position after being pivoted toward the guide when the cable is retracted by a squeeze handle. A flexible nonelastic cable, carried in a flexible cable housing, is connected at one end to the arm, at the other end to the squeezable handle. Compression of the squeezable handle retracts the cable imparting a torque to the arm, which engages the ratchet wheel and gripping element.

DESCRIPTION OF THE PREFERRED EMBODIMENT

Figure 1:
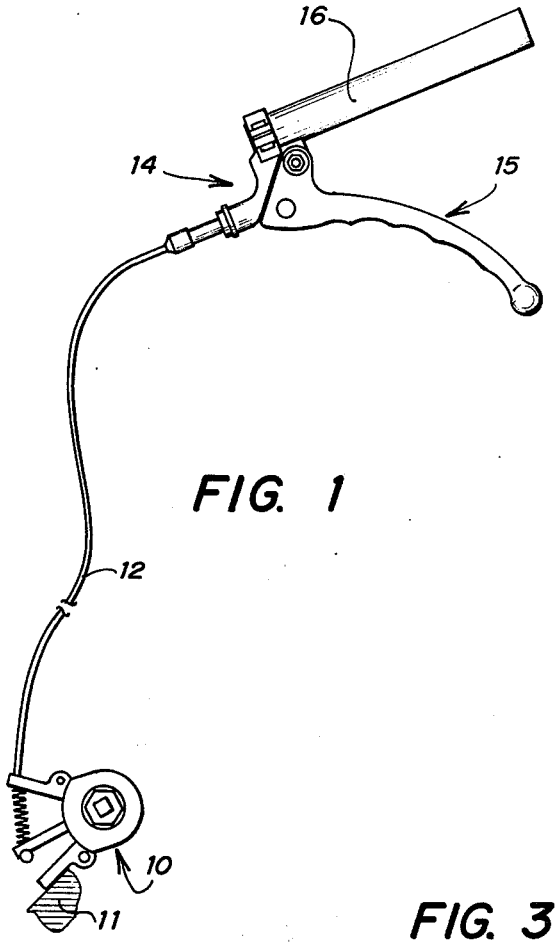
FIG. 1 is a general plan view of one embodiment of the invention.

Referring to FIG. 1, a wrench 10 is shown connected via a cable housing 12 to a squeezable handle 14. By applying pressure to a squeezable handle 14, wrench 10 can be operated from virtually any angle and from any distance, limited only by the length of cable housing 12. Cable housing 12 is designed to house a metal wire cable 23 which imparts a torque to wrench 10. Cable housing 12 is a hollow, flexible and sturdy housing, manufactured of metal. An exemplary material having the structural integrity and flexibility necessary to carry a cable imparting about 40 foot-pounds of torque would be the helically etched metal cable housing or helically joined compressed spring housing used in automobile speedometers.

Squeezable handle 14 is a commercially available squeeze handle, with a trigger 15, and handgrip 16 designed to reciprocate a wire cable such as the type of squeeze handle used to actuate the brakes or throttle in motorcycles.

Figure 2:
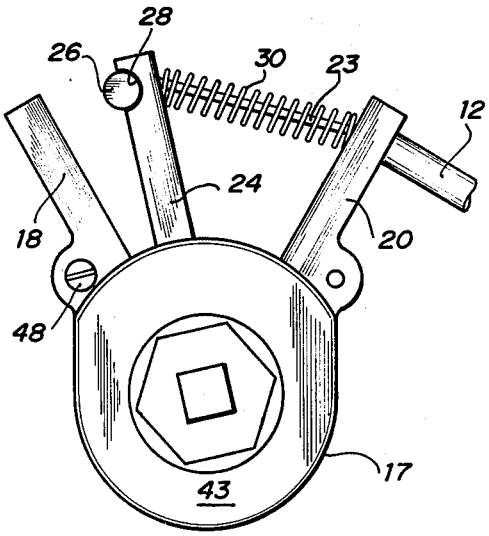
FIG. 2 is a plan view of the same embodiment of the invention, cut off at the cable.
Figure 3:
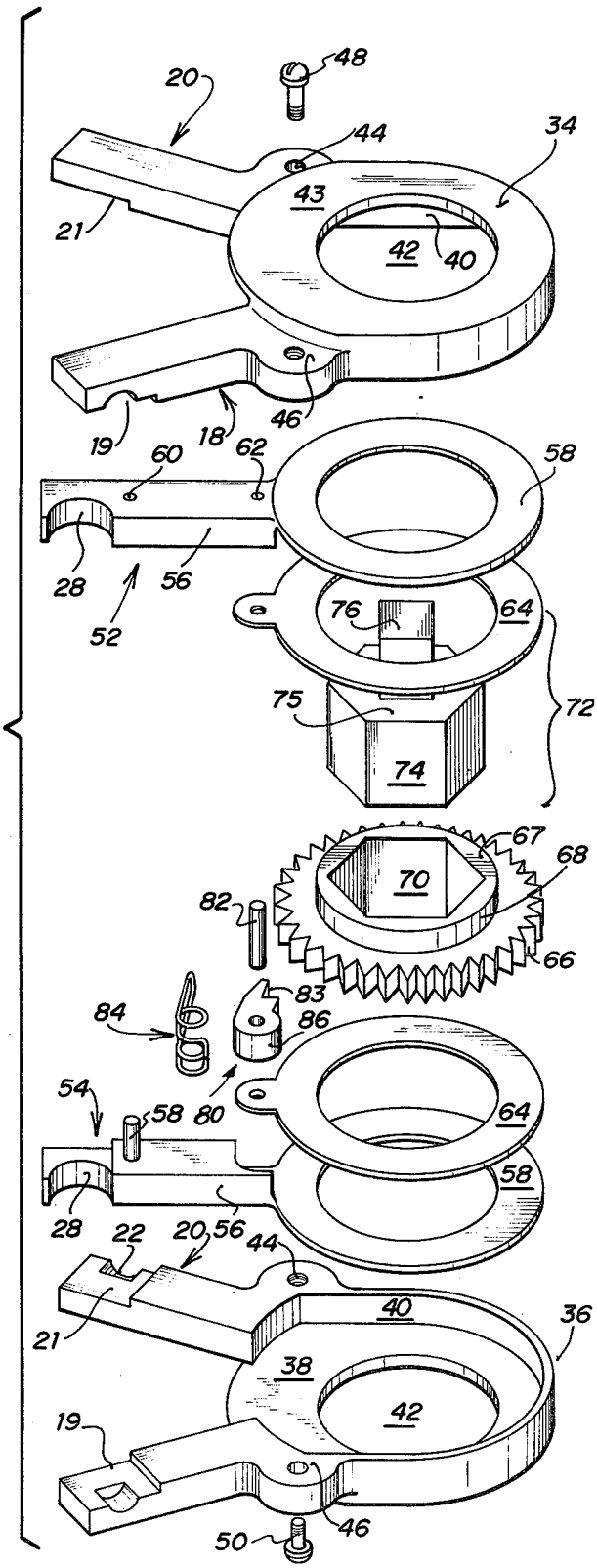
FIG. 3 is an exploded view of the same embodiment, cut off at the cable.

FIGS. 2 and 3 show wrench 10 in greater detail. A metal housing 17 receives a ratchet wheel 66, as shown in FIG. 3. A drive 68 mounted on both sides of the ratchet wheel extends through an aperture in housing 17 and receives a gripping element such as stud or socket. Also extending from housing 17 and made of the same material, are a strut 18 and a guide 20. Because housing 17 will tend to rotate when the wrench is actuated, thereby depriving it of its mechanical advantage, a restraining means, strut 18 is designed to engage some immovable object, such as the machinery under repair, to impede rotation of the housing and to restore the mechanical advantage to the wrench. In the removal of spark plugs from an automobile engine, for example, strut 18 would rest against the engine block 11 as shown in FIG. 1. As best shown in FIG. 3, strut 18 defines an open eyelet 19 at its extended edge in which an auxiliary slat could be inserted perpendicularly to provide a more effective catch mechanism, in the event that strut 18 fails to engage an immovable object. Housing 17 could also be held immovable by securing an attachable handle to strut 18.

Guide 20, likewise an extension from housing 17, provides support for cable housing 12 so that a torque can be applied to the wrench. As best shown in FIG. 3, eyelet 21, notched in the extended edge of guide 20, receives a wire cable which extends from cable housing 12 passing through eyelet 21 to a movable arm. Guide 20 contains a shallow bore 22 on its underside, shown in FIG. 3, adapted to receive the terminus of cable housing 12. Cable 23 is a flexible nondistensible metal wire which is carried in cable housing 12 and which reciprocates freely therein. One end is secured to trigger 15 of the squeezable handle; the other end is removably secured to movable arm 24. Cable 23 terminates in a small cylindrical plug 26 which rests in a semicircular groove 28 in movable arm 24.

Positioned between movable arm 24 and guide 20 is a spring 30. When squeezable handle 14 is released, the tension in cable 23 is relaxed and spring 30 in its compressed state forces movable arm 24 to pivot away from guide 20 until spring 30 is in its noncompressed state and movable arm 24 is in its rest position. Spring 30 is an ordinary machine compression spring, or alternatively, a v-shaped machine spring. A spring with an appropriate spring constant is chosen such that the angle between guide 20 and movable arm 24 in its rest position, when the spring is not compressed, provides maximum torque. In the preferred embodiment disclosed herein, for example, the angle which provides maximum torque is less than 30 degrees.

FIG. 3 shows the internal mechanism of the wrench 10 in more detail. Housing 17 is constructed of upper section 34 and lower section 36. As clearly depicted in the lower section 36, each section defines a hollowed out surface 38 substantially surrounded by a sidewall 40. Sidewall 40 surrounds surface 38 except between strut 18 and guide 20 where movable arm 24 must have freedom to pivot. Surface 38 defines a circular aperture 42 in each of the upper and lower sections configured slightly larger than the the drive 68 so that drive 68 will be exposed. The exterior surface 43 of the upper and lower housing sections lies in the same plane as the exposed face 69 of drive 68 as will be hereafter discussed in greater detail. Apertures 44 and 46 defined in each housing section adjacent the strut 18 and guide 20 are designed to register with the corresponding aperture in the corresponding section to receive fasteners 48 and 50 which secure the upper and lower sections to form the housing.

Movable arm 24 is shown constructed of upper and lower arm sections 52 and 54 each containing drive arm 56 and ring 58. The upper arm section 52 mates with the lower arm section 54 and is secured thereto by pin 60, which extends from lower arm section 54 into aperture 62 in upper arm section 52. Movable arm 24 bifurcates into rings 58 at the point where the arm extends from the housing. Between rings 58 is mounted the ratchet wheel 66.

Immediately inside rings 58 are washers 64 mounted on movable arm 24 to facilitate the movement of ratchet wheel 66 between rings 58. Ratchet wheel 66 is an ordinary sawtooth gear, the teeth of which are not inclined as in the more common ratchets. Ratchet wheel 66 is rotatably mounted between rings 58 of arm 24 to rotate freely therebetween. A drive 68 is integrally formed on both the upper and lower faces of ratchet wheel 66. Drive 68 has a flat cylindrical shape, the cylinder having sufficient height so that the exposed face 67 is in the same plane as the exterior surface 43 of the upper and lower sections of the housing. Drive 68 has circumference slightly less than that defined by aperture 42 in the upper and lower sections of the housing. Drive 68 defines a shallow polygonal cavity 70 which is designed to receive a gripping element such as a socket or stud of a chosen size, or a workpiece such as a nut or bolt which is sized to fit in cavity 70.

FIG. 3 shows a gripping element 72 consisting of a base 74 and square stud 76 rigidly mounted thereto. When gripping element 72 is received in cavity 70, the upper face 75 of base 74 lies in the same plane as the exterior surface 43 of the upper and lower housing and the exposed face 69 of drive 68. Stud 76 extends from the housing. While in the drawing stud 76 is shown with a square face, it will be understood that the face may be polygonal or circular.

Disposed in a notch in drive arm 56 between rings 58 is pawl 80, pivotally mounted in the drive arm 56 by a pin 82. Pawl 80 is essentially a cam with a tail 83 extending therefrom. The tail 83 is biased by a spring 84 to engage the teeth of ratchet wheel 66 as it moves in a counterclockwise direction. The arcuate surface 86 of the pawl is shaped such that the movement of the ratchet wheel 66 in a clockwise direction causes the pawl to rotate slightly causing tail 83 to disengage from the teeth of ratchet wheel, which permits the ratchet wheel 66 to slide freely thereunder. When ratchet wheel 66 again is rotated in a counterclockwise direction, the teeth engage the arcuate surface 86 and the spring 84 biases tail 83 to engage the teeth.

In the preferred embodiment, spring 84 is a single element spring partially circumscribing pawl 80 to bias it toward ratchet wheel 66. The use of spring 84 to bias pawl 80 to the ratchet wheel 66 permits the wrench to be operated in any position, especially upside down.

When trigger 15 of squeezable handle 14 is compressed against handgrip 16, tension is created in wire cable 23, displacing it toward the operator. The other end of cable 23 is attached to movable arm 24. The displacement of cable 23 causes movable arm 24 to pivot toward guide 20. The concomitant movement of pawl 80 which is spring-biased to engage the ratchet wheel results in the turning of the gripping means which may be a gripping element such as a socket or stud, or the polygonal cavity 70 in drive 68 of the ratchet wheel 66, when the wrench is applied directly to a workpiece of the same size as cavity 70. When squeezable handle 14 is released, compression spring 30 forces movable arm 24 to its rest position. The arcuate surface of pawl 80 in contact with the teeth of ratchet wheel 66 is engaged and rotated slightly preventing the interaction of tail 83 with the teeth of the ratchet wheel. As housing 17 is not permitted to rotate by strut 18 which engages the machinery upon which the wrench is operating, the effect of compressing squeezable handle 14 is to turn a socket or stud mounted in drive 68, imparting a torque to a workpiece such as a nut, bolt or sparkplug to which the wrench is attached. By inverting the wrench and using the drive on the opposite side of the ratchet wheel, the operator can reverse the direction of torque.

The present invention is especially advantageous in its application to automobile engines, such as in the removal of spark plugs, which may be inaccessible to ordinary socket or squeeze action wrenches. It has numerous other applications to machinery which provides little space for swinging a wrench handle or for actuating a squeeze handle. The present invention provides considerable advantage over the ordinary $\frac{3}{8}$ inch socket wrench with a 10 or 11 inch handle. This is because the operator, compressing the squeezable handle in an unconfined area can more rapidly actuate the wrench than in a confined area. The mechanical advantage of the present invention may be enhanced by increasing the length of the squeezable handle 14, as well as the number of teeth in the ratchet wheel. In one embodiment of the present invention successfully reduced to practice, a torque of about 40 foot-pounds was applied by the flexible cable. The wrench also can be adapted for use with various drives other than ⅜ inch drive by simply exchanging the gripping element.

The invention may also be adapted to operate as an ordinary socket wrench wherein strut 18 may be removed from the housing and the squeezable handle may be disengaged from the cable and attached to movable arm 24 by attaching the fixed portion of squeezable handle 14 to the guide 20 and the movable portion to movable arm 24.

In practice, the wrench may be operated either by attaching it to a nut or bolt in a confined area with the cable attached, or where the convenience of the operator dictates otherwise, placing the wrench 10 on the bolt, then attaching cable 23 to the movable arm 24 and passing it through guide 20.

Although particular embodiments of the invention have been described herein, it will be understood that the invention is not limited to the embodiments disclosed but is capable of rearrangement, modification and substitution of parts and elements without departing from the spirit of the invention.

What is claimed is:

1. A remote operated wrench comprising:

a flexible cable housing;

a flexible cable reciprocatingly carried within the housing;

a wrench housing having a guide extending therefrom, the guide receiving one end of the cable housing and permitting the cable to pass freely therethrough;

a ratchet rotatably mounted in the housing;

a movable arm pivotally mounted in the housing and extending therefrom for imparting a torque to the ratchet, the arm having one end of the cable connected thereto;

a pawl pivotally mounted on the movable arm and adapted to engage the teeth of the ratchet when the movable arm is pivoted in one direction only and adapted to slip freely over the ratchet when the arm is rotated in the opposite direction;

a gripping means rigidly mounted to the ratchet for gripping a threaded workpiece;

a restraining means for preventing movement of the housing when the gripping means is rotated; and a control means for retracting the cable in the cable housing to impart a torque to the arm.

2. The wrench of claim 1 wherein the ratchet defines a shallow cavity having a polygonal periphery adapted to receive a removably mounted gripping means.

3. The wrench of claim 1 wherein the control means is a squeezable handle capable of displacing a wire cable.

4. The wrench of claim 1 wherein the gripping means is a socket adapted to receive a threaded workpiece.

5. The wrench of claim 1 wherein the gripping means is a stud adapted to engage a threaded workpiece.

6. The wrench of claim 1 wherein the restraining means is a rigid strut extending from the wrench housing adapted to engage some immovable object to prevent the wrench housing from rotating when that wrench is actuated.

7. The wrench of claim 6 further comprising a handle removably attached to the strut to permit the operator to restrain movement of the wrench housing when the wrench is actuated.

8. The wrench of claim 6 wherein the strut defines a slot to receive a perpendicular slat adapted to engage some immovable object to prevent movement of the wrench housing when the wrench is actuated.

9. A ratchet wrench remotely operated by a flexible cable, said wrench comprising:

a flexible cable housing for receiving the flexible cable;

a flexible cable freely reciprocating within the flexible cable housing;

a wrench housing having a shoulder and a strut extending therefrom, the shoulder adapted to receive one end of the flexible cable housing and to permit the flexible cable to pass freely therethrough, the strut adapted to restrain movement of the wrench housing when the wrench is actuated;

a ratchet wheel having saw teeth, the wheel rotatably mounted in the wrench housing;

a movable arm pivotally mounted in the wrench housing and extending therefrom for imparting a torque to the ratchet wheel, the arm connected to the first end of the flexible cable;

a cam pivotally mounted in the arm, the cam having a tail extending therefrom to engage the ratchet wheel when the arm is pivoted in one direction only, the arm slipping freely over the ratchet wheel when the arm is pivoted in the opposite direction;

a first spring mounted in the arm for biasing the tail of the cam to engage the teeth of the ratchet wheel;

a second spring disposed between the shoulder and the arm for returning the arm to a rest position after the tension in the cable has been relaxed; and a squeezable handle, attached to the second end of the flexible cable, adapted to displace the cable to impart a torque to the arm.

* * * * *